United States Patent [19]

Tanaka

[11] Patent Number: 5,002,495

[45] Date of Patent: Mar. 26, 1991

[54] STATIC CHARGE PREVENTIVE CONNECTOR

[75] Inventor: Masanori Tanaka, Kobe, Japan

[73] Assignee: Hosiden Electronics Co., Ltd., Osaka, Japan

[21] Appl. No.: 495,965

[22] Filed: Mar. 20, 1990

[30] Foreign Application Priority Data

May 16, 1989 [JP] Japan ..... 1-56260[U]

[51] Int. Cl.[5] ..... H01R 13/648

[52] U.S. Cl. ..... 439/108; 439/181; 361/212

[58] Field of Search ..... 439/108, 181, 186, 92, 439/93, 187, 137, 138; 361/212, 220

[56] References Cited

U.S. PATENT DOCUMENTS 4,568,133 2/1986 Amano et al. ..... 439/181

4,711,506 12/1987 Tanaka ..... 439/108

FOREIGN PATENT DOCUMENTS 2127235 4/1984 United Kingdom ..... 439/138

*Primary Examiner*—Gary F. Paumen

*Attorney, Agent, or Firm*—Armstrong, Nikaido, Marmelstein, Kubovcik & Murray

[57] ABSTRACT

The disclosed connector is featured in prevention of static charges which are prone to generate and to give damage to the built-in circuits. The connector comprises a built-in receptacle component and a removable attachment connector, the built-in receptacle comprises a receptacle body shaped generally in a plate and made of an insulative material, and the receptacle body has a cavity internally, wherein a metallic first spring is disposed to extend outward to form a contact point, and a cover shaped in a plate and made of a conductive material is pivotably held to cover the contact point and has a slit to project the contact point out of the cover upon being pushed from outside, and a second spring, made of conductive material, is interposed between the receptacle body and the cover to urge the cover and to provide a ground connection to the cover, the attachment connector shaped in a plate comprises a contact made of a conductive material to correspond to the contact point of the first spring, whereby connection of the contact point of the first spring comprised in the receptacle body to the contact comprised in the attachment is made through a push of the cover to thereby avoid possible static charges.

1 Claim, 3 Drawing Sheets

STATIC CHARGE PREVENTIVE CONNECTOR

FIELD OF THE INVENTION

This invention relates to an electrical connector which connects electrical devices or parts without trouble due to static charges. More particularly, this invention relates to a connector of small size with static charge prevention.

DESCRIPTION OF THE CONVENTIONAL ART

Conventionally, expensive car mounted radios have been designed such that each radio set has a built-in body and a removable attachment to eliminate risk of theft while the driver is away, wherein the driver is able to take away the attachment when he leaves the car. This kind of radio has conventionally employed a pin connector as shown in FIG. 5.

FIG. 5 shows sectionally a receptacle of the built-in component 10 and a connector of the attachment 20, wherein the receptacle body 11 is covered with a metallic film 12 and provided with a female socket 13, and the attachment 20 has an insulated body 21 and a pin 22 at a center of a concaved space so that the pin 22 will be inserted into the socket 13.

However, such a conventional combination of the pin 22 and socket 13 needs a coupling length which is longer than a longitudinal length of the pin 22, wherein often the socket 13 is disposed in a deep position, which causes inconvenience that the connector assembly should have a longer length and further causes the trouble by static charges. That is, when a human comes close or in contact to the receptacle set 10, sometimes static charges are discharged into the built-in component, and cause damage to internal circuits.

SUMMARY OF THE INVENTION

This invention is free from the conventional disadvantages as noted and offers a connector having a short depth length and prevention from static charges.

The present invention is summarized as follows:

a static charge preventive connector comprising a built-in receptacle component and an attachment connector:

the built-in receptacle comprising;

a receptacle body shaped generally in a plate and made of an insulative material, the receptacle body having a cavity internally, wherein a first spring, made of a conductive material, is disposed to extend outward to form a contact point;

a cover shaped in a plate and made of a conductive material being pivotably held to cover the contact point and having a slit to project the contact point out of the cover upon being pushed from outside;

a second spring, made of conductive material, interposed between the receptacle body and the cover to urge the cover and to provide a ground connection to the conductive cover;

the attachment connector shaped in a plate and comprising a contact made of a conductive material to correspond to the contact point of the first spring;

whereby connection of the contact point of the first spring comprised in the receptacle body to the contact comprised in the attachment is made by pushing the cover to thereby avoid possible static charges.

BRIEF DESCRIPTION OF THE DRAWINGS

FIG. 5 shows a conventional combination of the receptacle and connector in section as already referred to.

DESCRIPTION OF EMBODIMENT(S) OF THE PRESENT INVENTION

Figure 1:
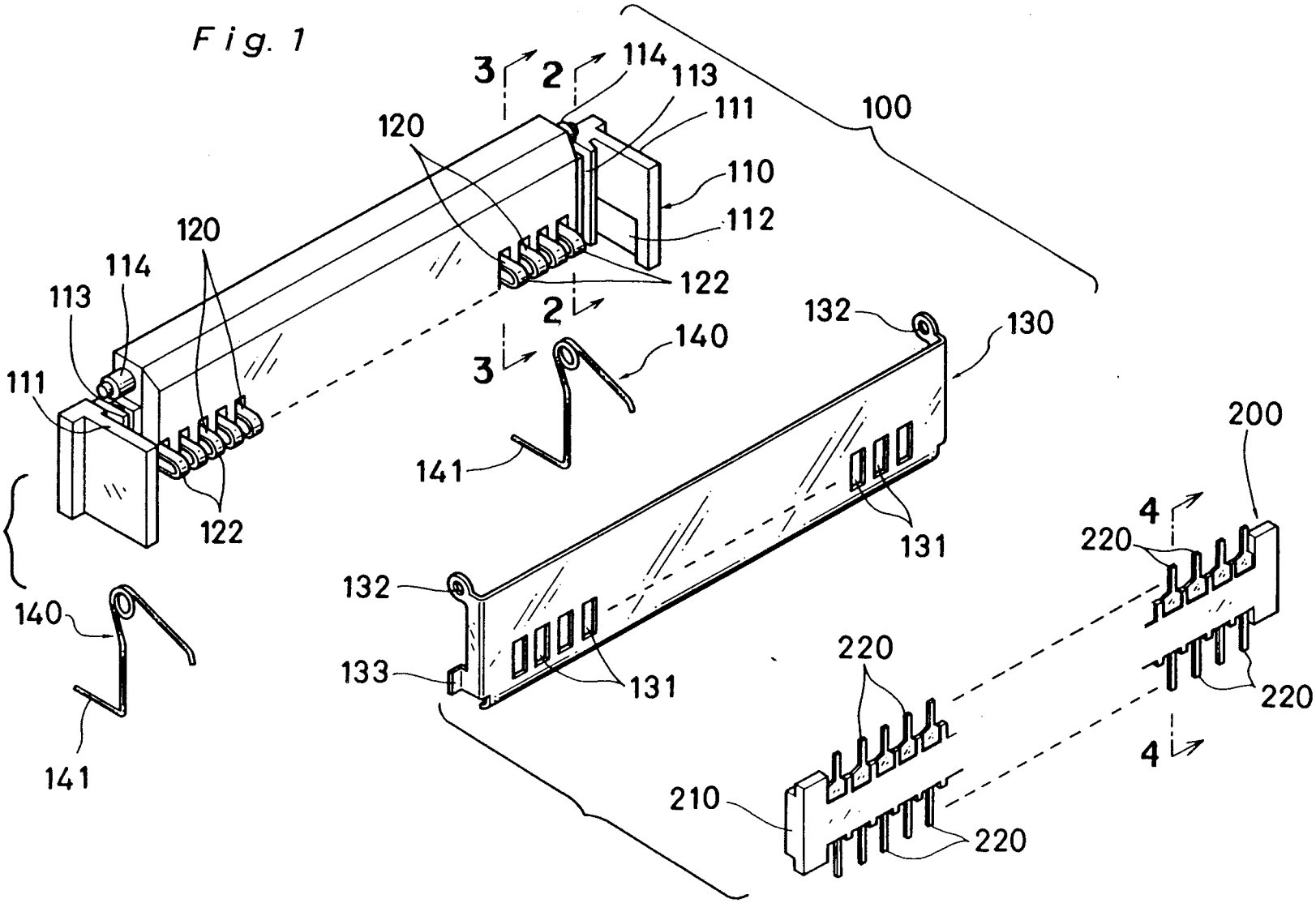
FIG. 1 shows an exploded perspective view of an embodiment of the inventive connector.

The inventive connector is defined generally by combination of a receptacle 100 of a built-in component and connector 200 of a removable attachment, wherein the receptacle 100 comprises a body 110 shaped in an elongate rectangle, a plurality of contacts 120 retained by the body 110, a cover 130 to protect the contacts 120, and a pair of springs 140 to bias the cover 130.

Figure 2:
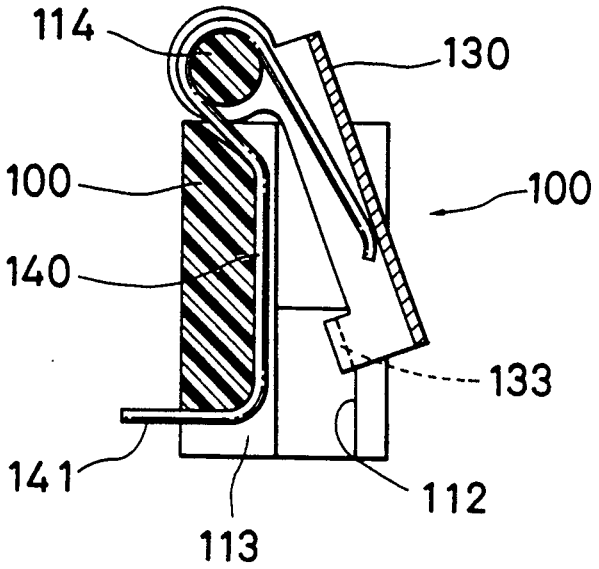
FIG. 2 shows a sectional view as viewed from the 2—2 arrow line in FIG. 1.
Figure 3:
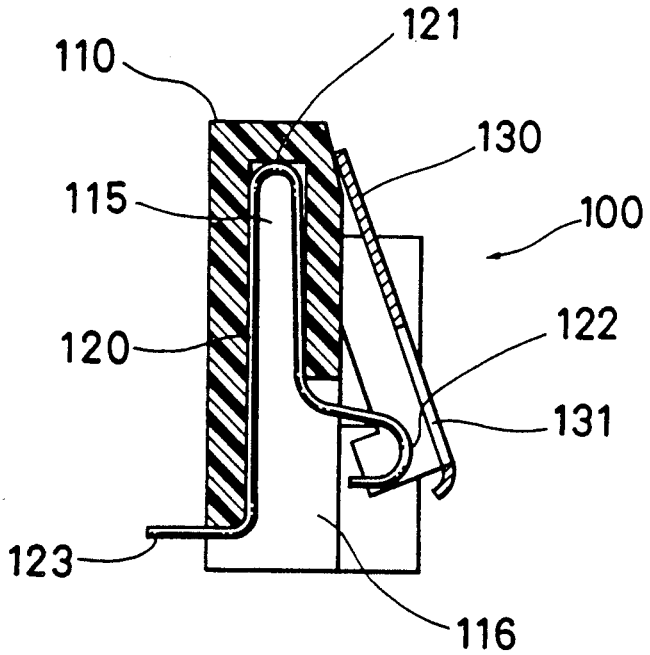
FIG. 3 shows a sectional view as viewed from the 3—3 arrow line in FIG. 1.

Referring to details of the receptacle 100, the body 110 is attached at opposite side with sides panels 111 which are provided with recessed stops 112 on the inner portion to stop the cover 130 by engagement, and the side panels 111 are provided with a side space 113 for receiving the spring 140 and the space 113 is extended to cut under portion of the body 110 as seen in FIG. 2, further above the space 113 a pin 114 extends each laterally so that the cover 130 and the spring 140 will be fastened around the pin 114 as will be apparent later. The, main portion of rectangular body 110, referred to as portion between the opposite spaces 113, is generally shaped to be an inverted "U" in cross-section as seen in FIG. 3, forming a plurality of cavities 115 with a predetermined interspace, each cavity 115 having an open bottom and a slit 116 to accommodate a contact member 120 in each cavity 115 as seen in FIG. 3 and as will be detailed later.

The contact members 120 are each made of metallic thin plate and bent in the middle to form an U letter portion 121. In mounting thereof, each contact member 120 is pushed into the cavity 115 at the slit 116 to be fit on internal walls of the body 110, wherein another portion 122 of the member 120 is bent to be rounded, which portion 122 is set to extend out of the slit 116 of the body 110, the portion 122 which will act as a contact point later retaining urging potential like a leaf spring. The other end of the member 120 extends out of the body 110 to act as lead line 123 for connection to wiring.

The cover 130 is made of a metallic plate and is provided with a plurality of slits 131 to have the contact portion 122 received therethrough. As seen in FIG. 1, the cover 130 is also provided at opposite sides with a pair of holed tabs 132 and a pair of lateral tabs 133, wherein each of the holed tabs 132 is intended to connect with the lateral pin 114 to thereby retain the cover 130 to be pivotal about the pin 114 so as to cover the front area ranging between the two side plates 111, and wherein each of the paired lateral tabs 133 is intended to engage with the stop 112 formed on the panel 111 so as to control the pivotal rotation of the cover 133. While the lateral tabs 133 are engaged with the stops 112, each contact portion 122 of the member 120 is designed to fit inside the cover 130 as seen in FIG. 3.

The spring 140 which urges the cover 130 is made of a metallic line having pivotal potential and is shaped generally in V letter with a coil at the pivot, wherein the pivot coil is connected to the pin 114 and one leg thereof is stopped by the cover 130, and thereby each of the paired springs 140 is urged between inside the cover 130 and the inner wall of the side space 113. And the portion of the spring 140 contacting the space wall 113 extends downwardly and then backwardly to produce a tail-out portion which will be used as grounding lead 141 as seen in FIG. 2.

Figure 4:
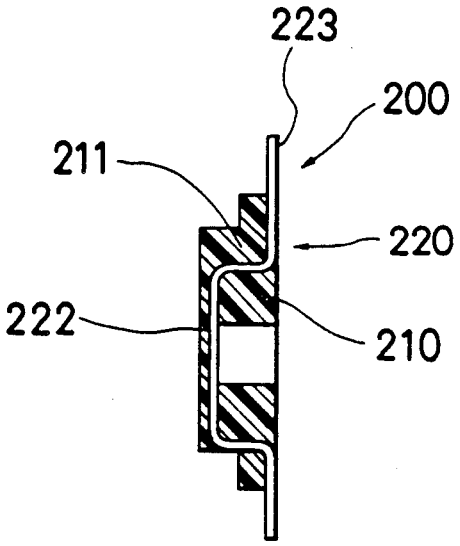
FIG. 4 shows a sectional view as viewed from the 4—4 arrow line in FIG. 1.
Figure 5:
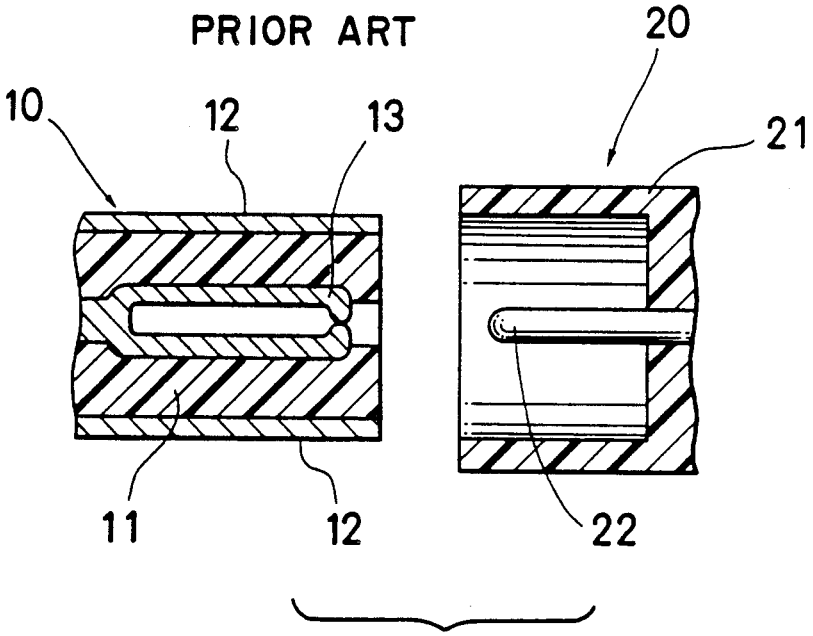
Fig. 5 PRIOR ART

The removable attachment 200 comprises a body plate 210 shaped generally in an elongate plate, made of an insulative material, and a plurality of contact members 220, wherein the body 210 has laterally a length comparable to the cover 130 and is intended to push against the cover 130. As is seen in FIG. 4, on one side of the body plate 210 a plurality of grooves 211 are provided for contact members 220 to be mounted therein.

Each of the contact members 220 for the attachment 200 is made of metallic thin strip having elasticity and electrical conductivity, wherein the middle portion 222 thereof is slightly bulged outward with intention that this middle portion is intended to act as real contact point to connect to the contact portion 120 of the built-in receptacle 100, and normally each contact member 220 is secured integrally by insertion molding, and said middle portion 222 is intended to act as actual contact point as noted above, and two opposite ends 223 are for further connection to wiring.

In the case of a receptacle combination as noted, the contacts 120 provided with the built-in component 100 are round or of U letter shape and held laterally interior of the body 110, and the contacts provided with the attachment 200 are of strip and held generally in parallel to the body 210. Further the cover 130 is roughly held in parallel to the body 110, wherein both the body 110 and body 210 are of plate to be contacted as plate to plate combination, which eliminates the need for a bulky connector combination.

Referring to operations and usage of the inventive connectors, in mounting an inventive connector combination to a radio set which is wanted to have the attachment to be separated from the built-in component. The connector 200 is attached to the attachment and the receptacle 100 is attached to the built-in component, wherein the grounding terminal 141 of the spring 140 is earthed.

When the attachment is separated from the built-in component. The cover 130 of the receptacle 100 is disposed in a position that the cover 130 is held as shown in FIGS. 2 and 3, wherein the contacts 122 of the contact members 120 are protected by the cover 130 as noted.

When the attachment is intended to connect to the built-in component, the cover 130 is pushed backward by the body 210, and thereby the contacts 122 of the contact members 120 project out of the slits 131, wherein contacts 122 and contacts 220 contact each other to form electrical connections.

If the hand or any finger having static charges comes close to or in contact with the cover 130, static charges are discharged via the cover 130 and the spring 140 to the grounding, whereby charges are prevented from discharging into circuits provided in the built-in component.

Thus, the inventive devices have a short length by employing the structure comprising plate to plate contacts, which will permit smaller overall size of removable devices to be included and offer more freedom in designing them, and although the device as a whole has a short depth length, contact points for built-in device are protected by the cover while in separation, and the cover is utilized to avoid the static charges from being discharged into sensitive circuits that would become damaged.

What is claim is:

1. A static charge preventive connector, comprising:

a built-in receptacle component, including (a) a generally plate-shaped receptacle body made of an insulative material and having a cavity therein, (b) a spring contact disposed in said cavity and extending outward therefrom, (c) a plate-shaped cover made of a conductive material and being cooperatively engageable with said body to pivot thereon such that said cover covers said contact, said cover having at least a slit corresponding to said spring contact, such that when said cover is pushed completely against said body, said spring contact extends outwardly from said cover through said slit, (d) a conductive spring means, interposed between said body and said cover, for biasing said cover away from said body and for establishing an electrical connection between a ground point on said body and said cover; and a generally plate-shaped attachment connector, including at least an attachment contact made of a conductive material and corresponding to said spring contact, such that when said attachment connector is pushed onto said receptacle component, engagement between said attachment connector and said cover occurs before engagement between said spring contact and said attachment contact, thus avoiding possible static discharging.

* * * * *